US012800164B2

(12) United States Patent
Li

(10) Patent No.: US 12,800,164 B2
(45) Date of Patent: Nov. 17, 2026

(54) DRIPPING SPRAY-TYPE AROMATHERAPY HUMIDIFIER

(71) Applicant: Chunsheng Li, Ganzhou (CN)

(72) Inventor: Changchun Li, Ganzhou (CN)

(73) Assignee: Chunsheng Li, Ganzhou (CN)

( * ) Notice: Subject to any disclaimer, the term of this patent is extended or adjusted under 35 U.S.C. 154(b) by 0 days.

(21) Appl. No.: 19/436,988

(22) Filed: Dec. 30, 2025

(65) Prior Publication Data

US 2026/0126190 A1 May 7, 2026

Related U.S. Application Data

(63) Continuation of application No. PCT/CN2024/094354, filed on May 21, 2024.

(30) Foreign Application Priority Data

May 22, 2023 (CN) ..... 202321241743.9

(51) Int. Cl.
*F24F 6/14* (2006.01)
*F24F 8/50* (2021.01)
(Continued)

(52) U.S. Cl.
CPC ..... *F24F 6/14* (2013.01); *F24F 8/50* (2021.01); *F24F 11/89* (2018.01); *F24F 2006/008* (2013.01)

(58) Field of Classification Search
CPC ..... F24F 6/12; F24F 6/14; F24F 8/50; F24F 11/0008; F24F 11/89; F24F 2006/008; F24F 2221/02
(Continued)

(56) References Cited

U.S. PATENT DOCUMENTS 7,963,460 B2 * 6/2011 Jorgensen ..... A61L 9/122 239/289
7,992,801 B2 * 8/2011 Jorgensen ..... A61M 11/005 239/289
(Continued)

FOREIGN PATENT DOCUMENTS

CN 207688334 U 8/2018
CN 110553332 A * 12/2019
(Continued)

OTHER PUBLICATIONS

English Machine Translation of CN 110553332 A (Year: 2019).*
English Machine Translation of CN 210220121 U (Year: 2020).*
English Machine Translation of CN 111219828 A (Year: 2020).*

*Primary Examiner* — Charles S Bushey
(74) *Attorney, Agent, or Firm* — Nitin Kaushik

(57) ABSTRACT

Disclosed is a dripping spray-type aromatherapy humidifier, including a humidifier main body, a guide cylinder connected to the humidifier main body, and a water storage cover located at an upper portion of the guide cylinder. The humidifier further includes a drip hole formed in the water storage cover, and a mist spray hole for spraying mist is formed in the water storage cover. The humidifier further includes a water baffle arranged close to an inner side of the mist spray hole and used for preventing mist water from blocking the mist spray hole. The guide cylinder is of an internal hollow structure, and the atomization assembly is located at a bottom portion of the guide cylinder. Mist and mist water generated by the atomization assembly reach the water storage cover after passing through the guide cylinder and drip downward from the drip hole.

12 Claims, 6 Drawing Sheets

(51) Int. Cl.
*F24F 11/89* (2018.01)
*F24F 6/00* (2006.01)

(58) Field of Classification Search
USPC ..... 261/81, DIG. 48
See application file for complete search history.

(56) References Cited

U.S. PATENT DOCUMENTS

| | | | | |
|---|---|---|---|---|
| 10,989,424 | B2 * | 4/2021 | Deng | F24F 13/20 |
| 11,458,500 | B2 * | 10/2022 | Lee | B05B 17/0615 |
| 11,835,256 | B1 * | 12/2023 | Li | F24F 6/00 |
| 12,161,783 | B1 * | 12/2024 | Fang | F24F 6/16 |
| 12,516,831 | B1 * | 1/2026 | Li | F24F 6/12 |
| 12,539,346 | B2 * | 2/2026 | Bernstein | A61L 9/14 |
| 2019/0321849 | A1 * | 10/2019 | Zu | F24F 13/24 |
| 2024/0240814 | A1 * | 7/2024 | Li | A61L 9/14 |

FOREIGN PATENT DOCUMENTS

| | | | | |
|---|---|---|---|---|
| CN | 210220121 | U | * | 3/2020 |
| CN | 111219828 | A | * | 6/2020 |
| CN | 212842003 | U | | 3/2021 |
| CN | 216977041 | U | | 7/2022 |
| CN | 115970037 | A | | 4/2023 |

* cited by examiner

DRIPPING SPRAY-TYPE AROMATHERAPY HUMIDIFIER

CROSS-REFERENCE TO RELATED APPLICATIONS

The application claims priority to Chinese patent application No. 202321241743.9, filed on May 22, 2023, the entire contents of which are incorporated herein by reference.

TECHNICAL FIELD

This disclosure relates to the technical field of aromatherapy humidifier products, and in particular, to a dripping spray-type aromatherapy humidifier with outstanding application effects and excellent user experience.

BACKGROUND

Aromatherapy diffusers and humidifiers are common products in people's daily lives, featuring in various shapes and sizes to provide consumers with a wide range of choices. Especially in recent years, the structural feature of combining atomizing mist components with lighting components has significantly improved the user experience of humidifier and aromatherapy diffuser products.

For example, the invention patent with application number CN202310080449.2 and patent name "AROMATHERAPY DIFFUSER WITH RAINDROP EFFECT" specifically discloses an aromatherapy diffuser with a raindrop effect, including a bottom shell, a water tank arranged in the bottom shell, and an atomization module arranged on the water tank. A cloud-shaped shell is arranged above the water tank, and the water tank is provided with a water pump module used for pumping liquid in the water tank into the cloud-shaped shell. A lower end of the cloud-shaped shell is provided with a drainage hole, and a light source capable of emitting light of different colors is further arranged in the cloud-shaped shell. During operation, water contained in the water tank is pumped by the water pump module into the cloud-shaped shell, and water in the cloud-shaped shell is discharged downward through the drainage hole, forming raindrops that fall into the water tank and are then pumped back into the cloud-shaped shell by the water pump module, thereby forming a cycle to simulate a scene of raindrops forming as clouds rain. Meanwhile, the light source in the cloud-shaped shell can emit light of different colors, so as to achieve a scene of simulating the change of colors of the cloud, and the mist generated by the atomization module drifts upward to the lower end or a periphery of the cloud-shaped shell, forming a rainbow simulation effect under the action of the light.

The above-mentioned aromatherapy diffuser product uses a water pump to pump water to a high position, which then drips down, ultimately achieving a rainbow-like atomization effect. However, the structure of the product in the prior art has a water pump module, which not only increases the cost of the product, but also is not conducive to maintenance.

Based on this, what kind of structure can be used to reduce the cost of the product without affecting the user experience is a problem considered by a person skilled in the art.

SUMMARY

A problem in the prior art to be resolved in this disclosure lies in that:

In the prior art, aromatherapy diffusers, humidifiers or similar products with a dripping function generally use a water pump to pump water to a high position, which then drips down, ultimately achieving a rainbow-like atomization effect. However, the structure of the product in the prior art has a water pump module, which not only increases the cost of the product, but also is not conducive to maintenance.

This disclosure resolves the technical problems with the following solution:

- a dripping spray-type aromatherapy humidifier is provided, including a humidifier main body, a guide cylinder connected to the humidifier main body, and a water storage cover located at an upper portion of the guide cylinder; a control circuit board and an atomization assembly being arranged in the humidifier main body; and further including a drip hole formed in the water storage cover, where
- a mist spray hole for spraying mist is formed in the water storage cover; and the humidifier further includes a water baffle arranged close to an inner side of the mist spray hole and used for preventing mist water from blocking the mist spray hole;
- the guide cylinder is of an internal hollow structure, and the atomization assembly is located at a bottom portion of the guide cylinder; and mist and mist water generated by the atomization assembly reach the water storage cover after passing through the guide cylinder and drip downward from the drip hole;
- a water storage tank for storing water is formed in the humidifier main body; and water dripping from the drip hole flows into the water storage tank; and
- the atomization assembly is electrically connected to the control circuit board.

Preferably, an inner side of a connection part between the bottom portion of the guide cylinder and the humidifier main body is further provided with an atomization energy-gathering cylinder for increasing a height of mist and water sprayed from the atomization assembly;

- the atomization energy-gathering cylinder is connected to an inner side of the humidifier main body or integrally formed therewith; and
- the atomization energy-gathering cylinder is located at an upper portion of the atomization assembly.

Preferably, an atomization piece sinking groove for embedding the atomization energy-gathering cylinder is further formed in the inner side of the humidifier main body;

- the atomization assembly is mounted at a bottom portion of the atomization piece sinking groove; and
- a water inlet groove for supplying water to the atomization piece sinking groove is formed in a connection part between the guide cylinder and the humidifier main body or in the bottom portion of the guide cylinder; and water in the water storage tank flows into the atomization piece sinking groove through the water inlet groove.

Preferably, the water storage cover includes a lower water storage cover, an upper water storage cover, and a water-blocking light-transmitting cover located between the lower water storage cover and the upper water storage cover;

- a top portion of the guide cylinder is connected to the lower water storage cover in a matching manner;
- a water mist hole for allowing the mist to flow from the guide cylinder into the water storage cover is formed in the lower water storage cover; and
- a mist outlet groove for allowing the mist to flow from the water storage cover to the mist spray hole is formed in the water-blocking light-transmitting cover; and the water baffle is arranged close to the mist outlet groove.

Preferably, the humidifier main body includes a lower cover;

the water storage tank is located at an upper portion of the lower cover; and the control circuit board and the atomization assembly are located in an internal space between a bottom portion of the water storage tank and the lower cover.

Preferably, a decorative shaped cover is further arranged at an upper portion of the water storage tank;

a guide cylinder through-hole for penetrating through the guide cylinder is formed in the shaped cover;

a backflow hole and/or a vent hole for returning water droplets dripping from the drip hole and in communication with the guide cylinder are/is further formed in the shaped cover; and an air inlet hole is formed in the guide cylinder.

Preferably, an assembly limiting rib is arranged on a periphery of the guide cylinder; and a buckle matching the assembly limiting rib is arranged on an inner side of the guide cylinder through-hole of the shaped cover, and is used for limiting a relative position between the shaped cover and the guide cylinder.

Preferably, an LED light board for producing a lighting effect is arranged inside the humidifier main body or the guide cylinder or inside the water storage cover;

light-transmitting holes are respectively formed in the upper water storage cover and the water-blocking light-transmitting cover; and the water-blocking light-transmitting cover is of a transparent or translucent structure.

Preferably, a water level detection switch electrically connected to the control circuit board is further arranged on the inner side of the humidifier main body; and a water level detection position corresponding to a position of the water level detection switch is arranged at the bottom portion of the water storage tank.

Preferably, a water storage cavity for storing water is arranged in the water storage cover; and the water baffle is located at an upper side of the water mist hole in a vertical direction.

A technical effect achieved in this disclosure by resolving the technical problem is as follows:

Compared with the prior art, a dripping spray-type aromatherapy humidifier of this disclosure is provided with a humidifier main body, a guide cylinder 15 connected to the humidifier main body, and a water storage cover located at an upper portion of the guide cylinder 15 simultaneously; a control circuit board 112 and an atomization assembly 12 are arranged in the humidifier main body; the humidifier further includes a drip hole 172 formed in the water storage cover, and a mist spray hole 191 for spraying mist is formed in the water storage cover; the humidifier further includes a water baffle 182 arranged close to an inner side of the mist spray hole 191 and used for preventing mist water from blocking the mist spray hole 191; the guide cylinder 15 is of an internal hollow structure, and the atomization assembly 12 is located at a bottom portion of the guide cylinder 15; mist and mist water generated by the atomization assembly 12 reach the water storage cover after passing through the guide cylinder 15 and drip downward from the drip hole 172; a water storage tank 13 for storing water is formed in the humidifier main body; water dripping from the drip hole 172 flows into the water storage tank 13; and the atomization assembly 12 is electrically connected to the control circuit board 112. In the actual application process, mist generated by the atomization assembly 12 flows into the water storage cover after passing through the guide cylinder 15 and drips downward from the drip hole 172, and mist is sprayed out from the mist spray hole 191. The arrangement of the water baffle 182 can effectively prevent mist water from blocking the mist spray hole 191, making the product operation more stable and extending its service life.

In the figures: 11. lower cover; 111. heat dissipation hole; 112. control circuit board; 113. water level detection position; 12. atomization assembly; 13. water storage tank; 131. atomization piece sinking groove; 14. atomization energy-gathering cylinder; 15. guide cylinder; 16. shaped cover; 161. guide cylinder through-hole; 162. backflow hole and/or vent hole; 17. lower water storage cover; 172. drip hole; 18. water-blocking light-transmitting cover; 181. mist outlet groove; 182. water baffle; 192, 183. light-transmitting hole; 19. upper water storage cover; 191. mist spray hole.

DETAILED DESCRIPTION OF THE EMBODIMENTS

To make the purposes, technical solutions, and advantages of this disclosure clearer, the following further describes this disclosure in detail with reference to the accompanying drawings and embodiments. It should be understood that, specific embodiments described herein are merely used to explain this disclosure but not to limit this disclosure.

Figure 1:
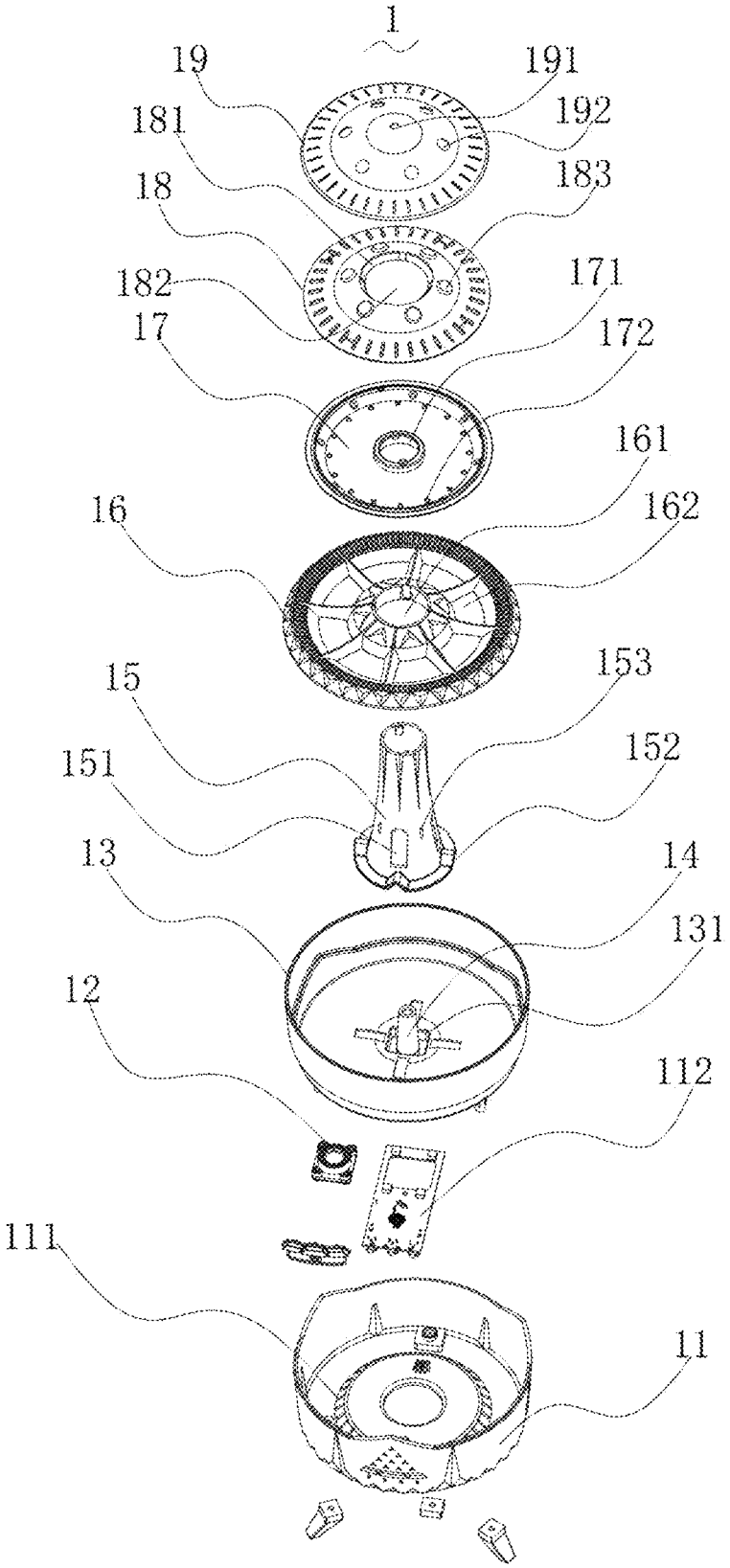
FIG. 1 and FIG. 2 are exploded structural schematic diagrams of a dripping spray-type aromatherapy humidifier according to this disclosure.
Figure 2:
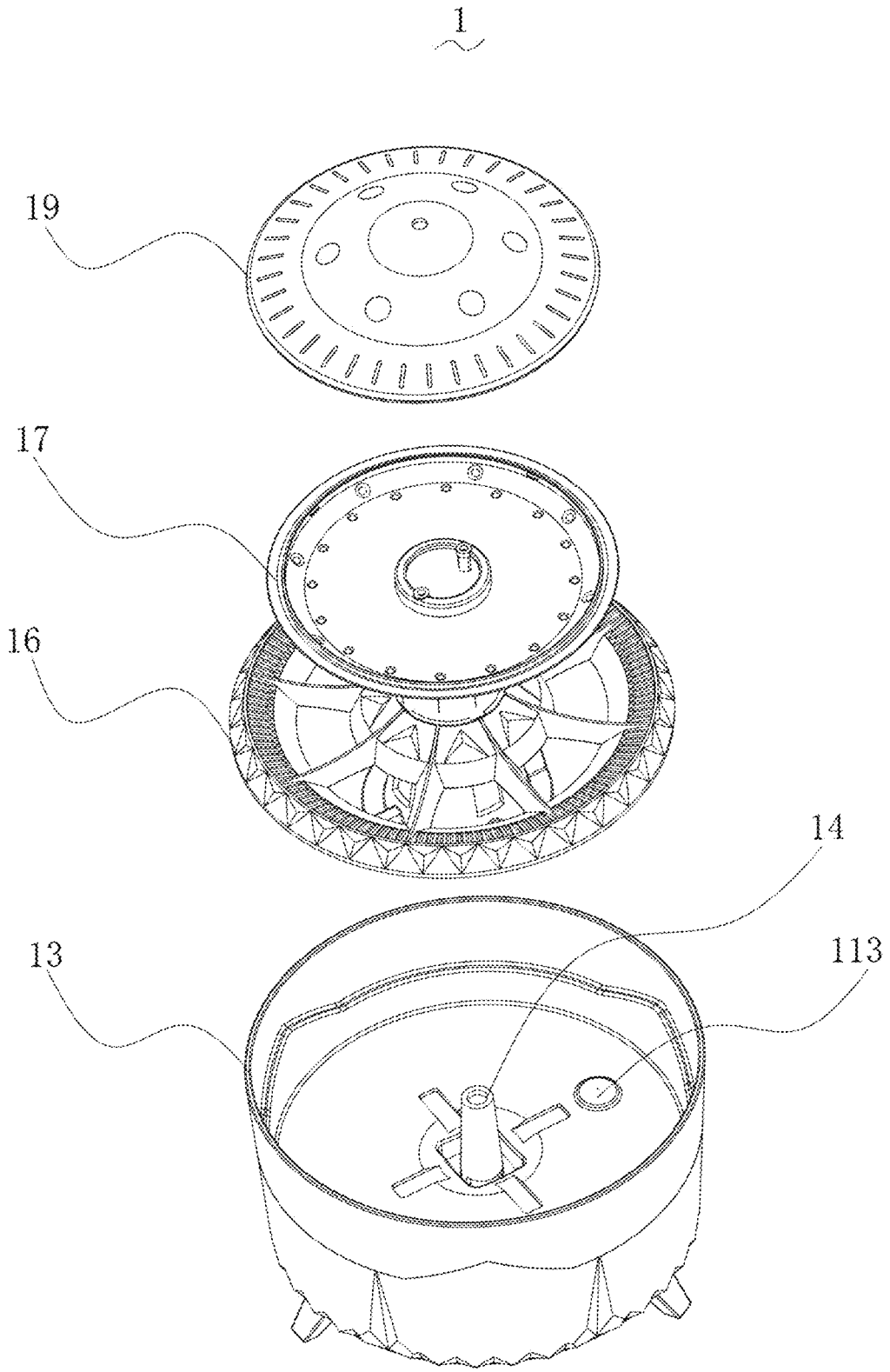
Figure 3:
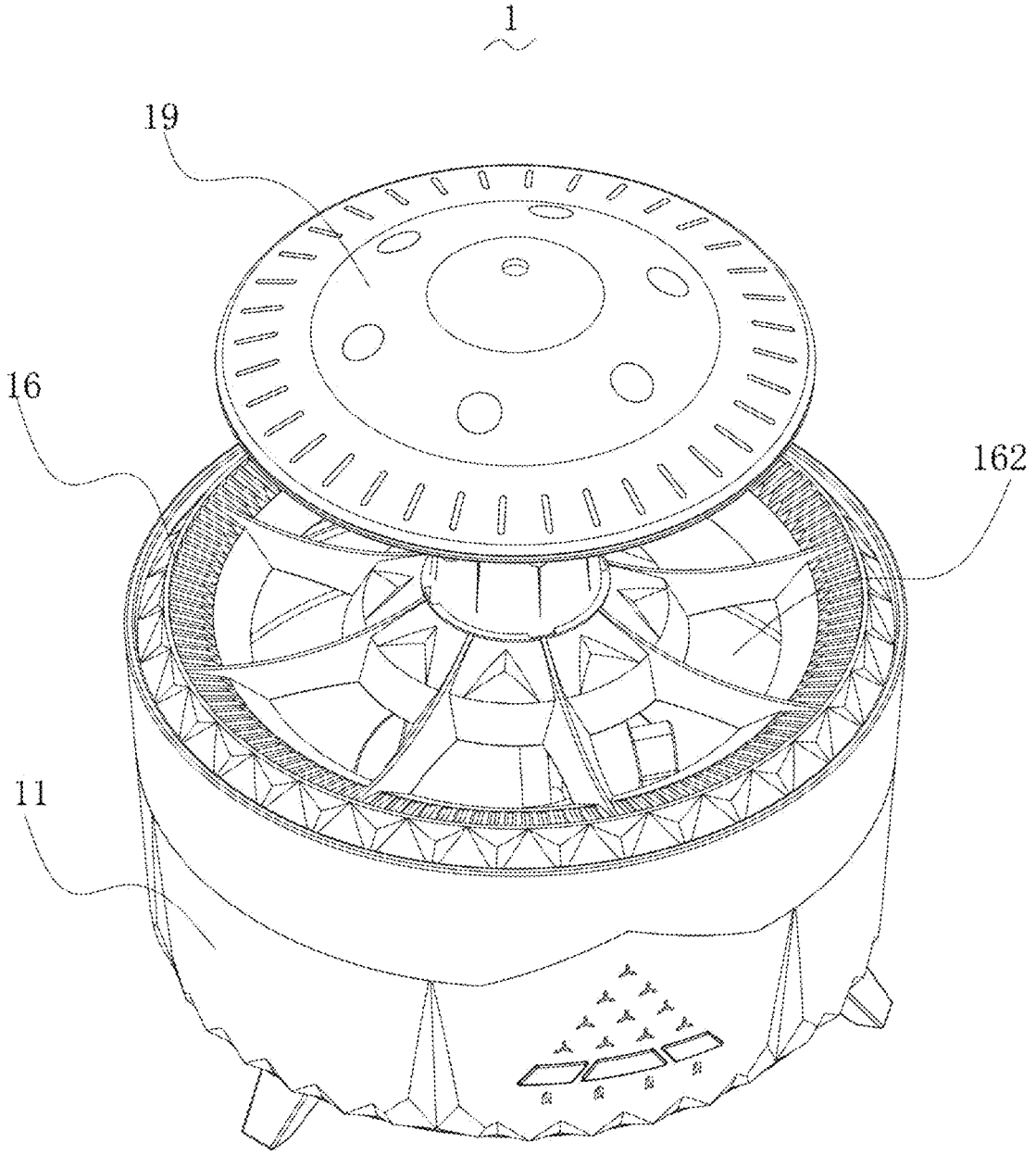
FIG. 3 is a schematic structural diagram of a three-dimensional state of a dripping spray-type aromatherapy humidifier according to this disclosure.
Figure 4:
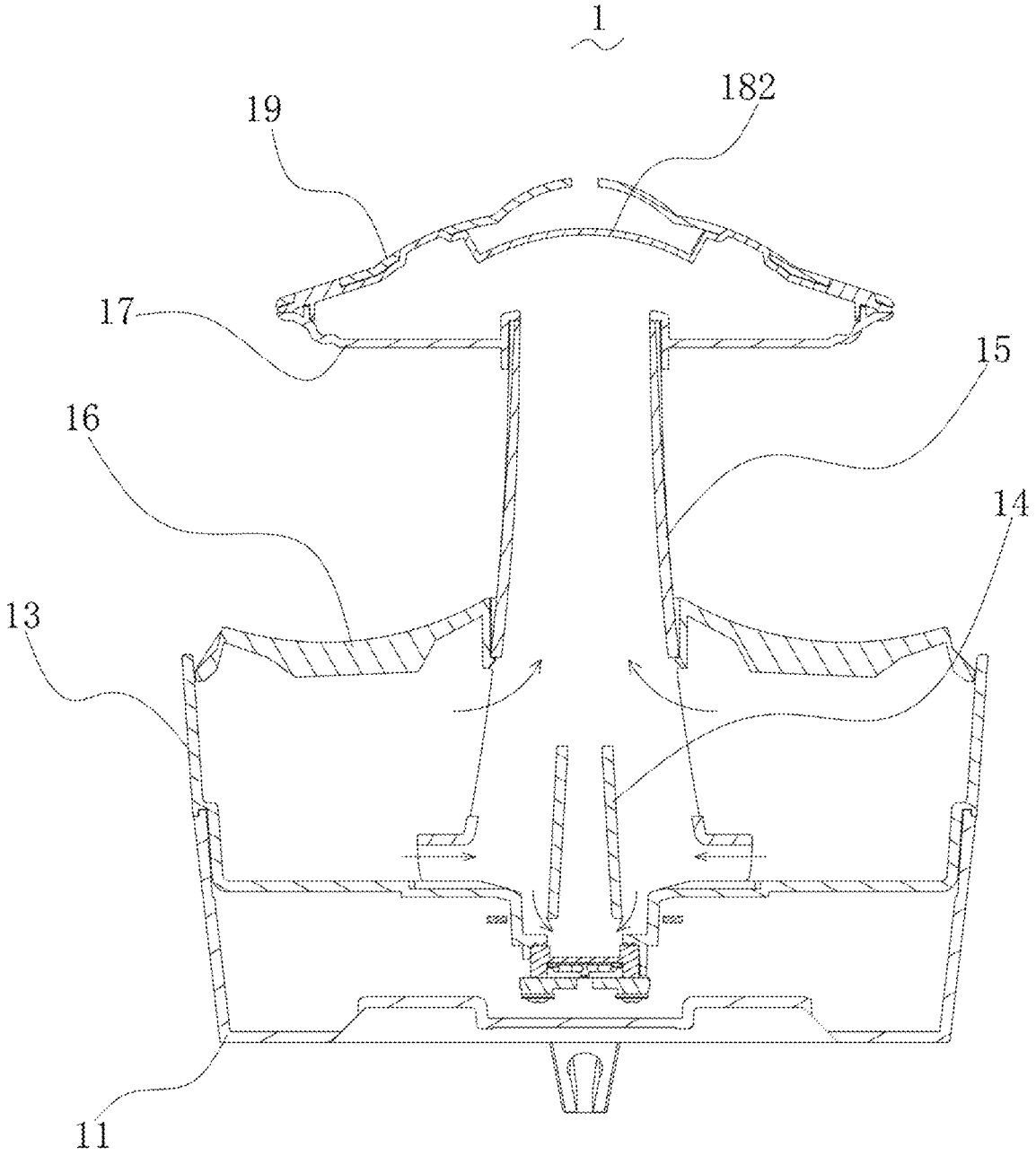
FIG. 4 to FIG. 6 are schematic structural diagrams of a cross-section state of a dripping spray-type aromatherapy humidifier according to this disclosure.
Figure 5:
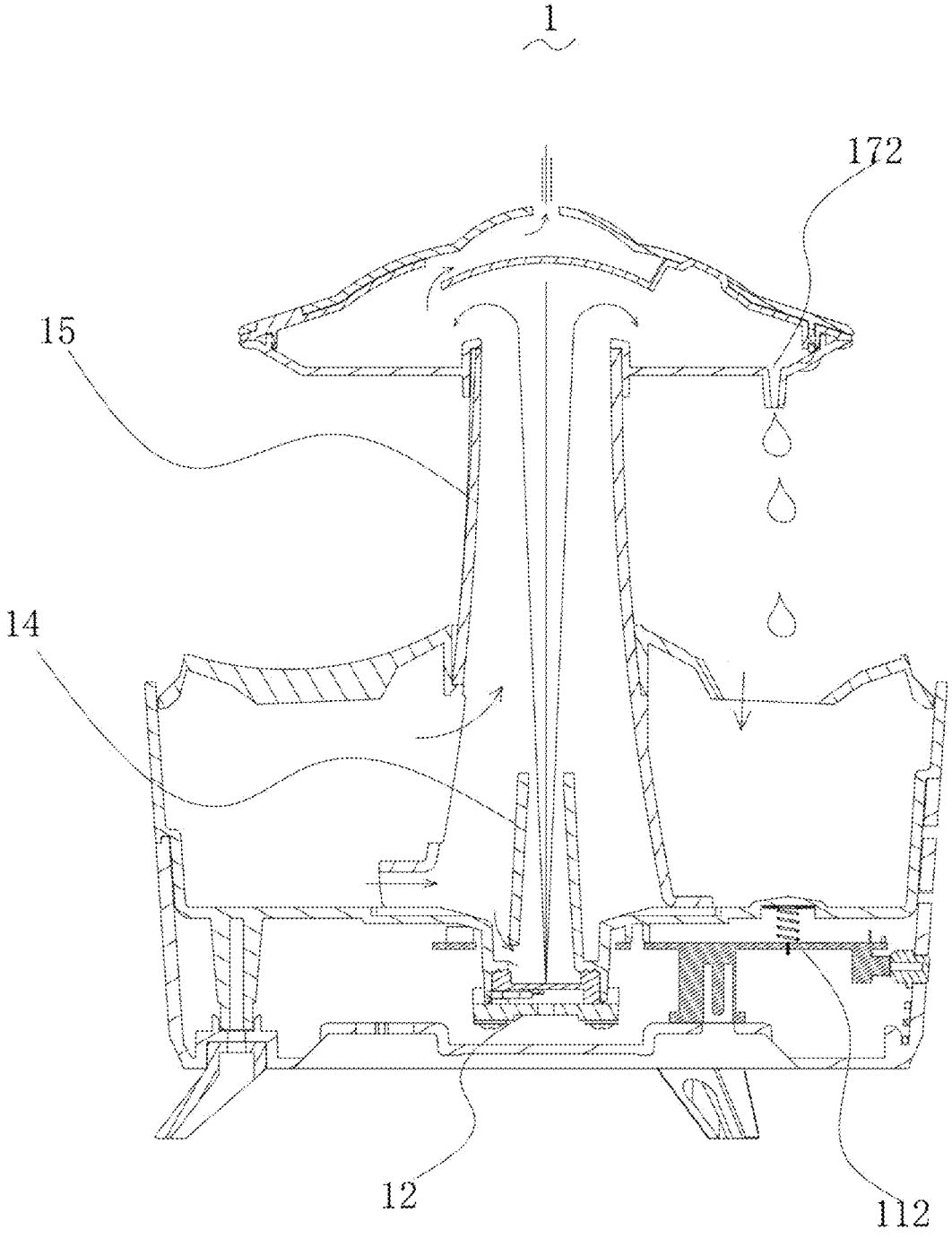
Figure 6:
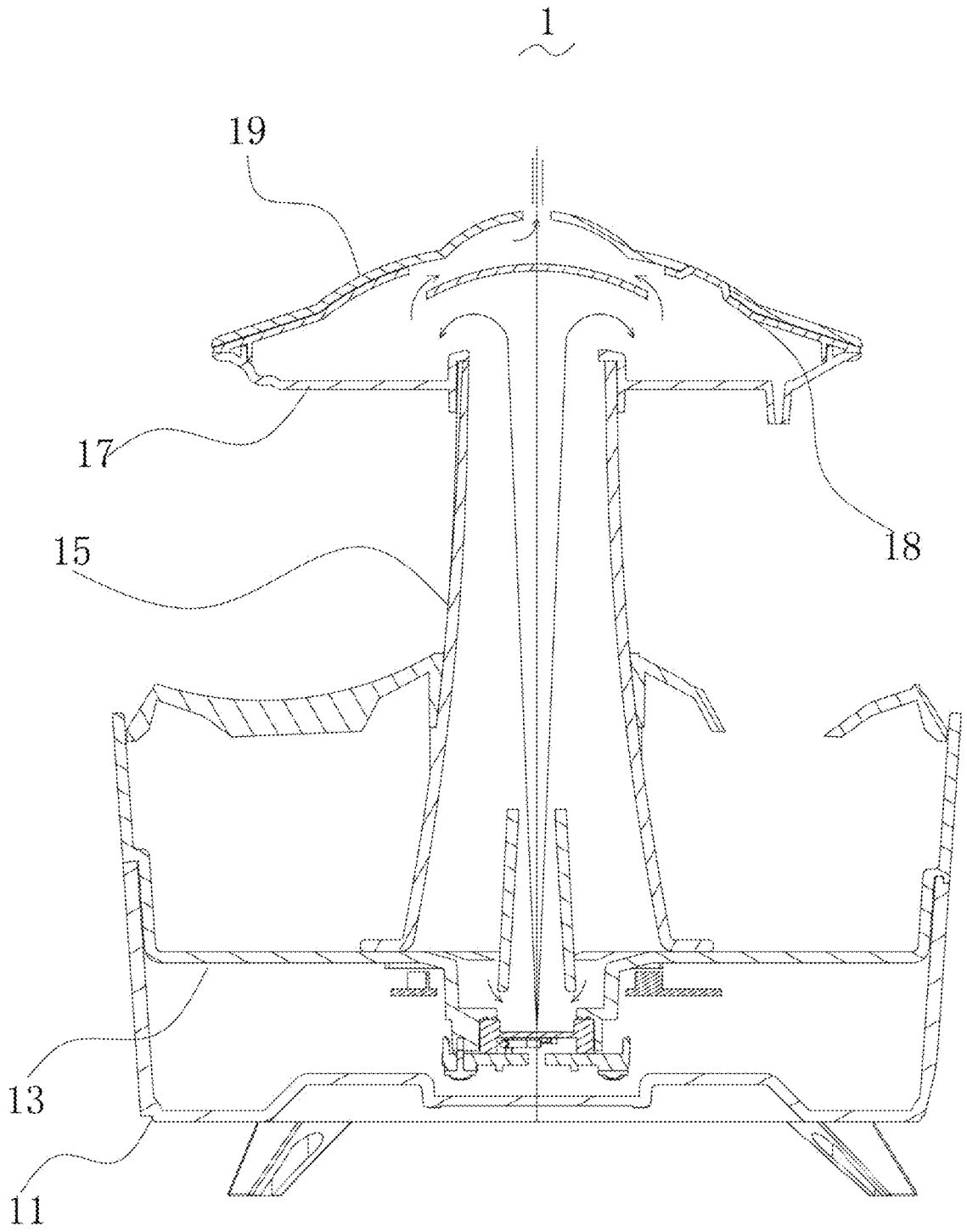

Referring to FIG. 1 to FIG. 6, a dripping spray-type aromatherapy humidifier 1 of this disclosure includes a humidifier main body, a guide cylinder 15 connected to the humidifier main body, and a water storage cover located at an upper portion of the guide cylinder 15; a control circuit board 112 and an atomization assembly 12 being arranged in the humidifier main body; further includes a drip hole 172 formed in the water storage cover, where the humidifier main body can be of a cylindrical structure as a whole; and a control button is arranged on an outer side of the humidifier main body;

a mist spray hole 191 for spraying mist is formed in the water storage cover; and the humidifier further includes a water baffle 182 arranged close to an inner side of the mist spray hole 191 and used for preventing mist water from blocking the mist spray hole 191;

the mist spray hole 191 can be formed in a central position of the upper portion of the water storage cover;

the guide cylinder 15 is of an internal hollow structure, and the atomization assembly 12 is located at a bottom portion of the guide cylinder 15; and mist and mist water generated by the atomization assembly 12 reach the water storage cover after passing through the guide cylinder 15 and drip downward from the drip hole 172;

a water storage tank 13 for storing water is formed in the humidifier main body; water dripping from the drip hole 172 flows into the water storage tank 13; and in the vertical direction, the drip hole 172 should be arranged in a one-to-one correspondence with the water storage tank 13, so as to facilitate the dropping of water into the water storage tank 13; and the atomization assembly 12 is electrically connected to the control circuit board 112.

This disclosure is provided with a humidifier main body, a guide cylinder 15 connected to the humidifier main body, and a water storage cover located at an upper portion of the guide cylinder 15 simultaneously; a control circuit board 112 and an atomization assembly 12 are arranged in the humidifier main body; the humidifier further includes a drip hole 172 formed in the water storage cover, and a mist spray hole 191 for spraying mist is formed in the water storage cover; the humidifier further includes a water baffle 182 arranged close to an inner side of the mist spray hole 191 and used for preventing mist water from blocking the mist spray hole 191; the guide cylinder 15 is of an internal hollow structure, and the atomization assembly 12 is located at a bottom portion of the guide cylinder 15; mist and mist water generated by the atomization assembly 12 reach the water storage cover after passing through the guide cylinder 15 and drip downward from the drip hole 172; a water storage tank 13 for storing water is formed in the humidifier main body; water dripping from the drip hole 172 flows into the water storage tank 13; and the atomization assembly 12 is electrically connected to the control circuit board 112. In the actual application process, mist generated by the atomization assembly 12 flows into the water storage cover after passing through the guide cylinder 15 and drips downward from the drip hole 172, and mist is sprayed out from the mist spray hole 191. The arrangement of the water baffle 182 can effectively prevent mist water from blocking the mist spray hole 191, making the product operation more stable and extending its service life.

Water sprayed by the operation of the atomization assembly 12 is delivered to the cloud-shaped cover (i.e., the water storage cover), and then drips back into the water tank (i.e., the water storage tank 13) through the drip hole 172 on the cloud-shaped cover; in addition, the mist atomized by the atomization piece drifts outward to form mist, and combined with the light effect, a visual effect of cloud, rain and mist is achieved.

During the operation of the atomization assembly 12, water mist is ejected into a water storage cavity of the water storage cover, so that pressure is applied inside the water storage cavity, thereby extruding the mist inside the water storage cavity into columnar mist through the mist spray hole 191; and the number of the mist spray holes 191 may be single or multiple.

An inner side of a connection part between the bottom portion of the guide cylinder 15 and the humidifier main body is further provided with an atomization energy-gathering cylinder 14 for increasing a height of mist and water sprayed from the atomization assembly 12;

the atomization energy-gathering cylinder 14 is connected to an inner side of the humidifier main body or integrally formed therewith; and the atomization energy-gathering cylinder 14 is located at an upper portion of the atomization assembly 12.

An atomization piece sinking groove 131 for embedding the atomization energy-gathering cylinder 14 is further formed in the inner side of the humidifier main body;

the atomization assembly 12 is mounted at a bottom portion of the atomization piece sinking groove 131; and the purpose of arranging the atomization piece sinking groove 131 is that when the water volume in the water Storage tank 13 is low, the atomization piece can fully operate underwater and is not prone to burnout.

A water inlet groove 152 for supplying water to the atomization piece sinking groove 131 is formed in a connection part between the guide cylinder 15 and the humidifier main body or in the bottom portion of the guide cylinder 15; and water in the water storage tank 13 flows into the atomization piece sinking groove 131 through the water inlet groove 152.

The water storage cover includes a lower water storage cover 17, an upper water storage cover 19, and a water-blocking light-transmitting cover 18 located between the lower water storage cover 17 and the upper water storage cover 19;

a top portion of the guide cylinder 15 is connected to the lower water storage cover 17 in a matching manner;

a water mist hole 171 for allowing the mist to flow from the guide cylinder 15 into the water storage cover is formed in the lower water storage cover 17; and a mist outlet groove 181 for allowing the mist to flow from the water storage cover to the mist spray hole 191 is formed in the water-blocking light-transmitting cover 18; and the water baffle 182 is arranged close to the mist outlet groove 181.

The humidifier main body includes a lower cover 11;

the water storage tank 13 is located at an upper portion of the lower cover 11; and the control circuit board 112 and the atomization assembly 12 are located in an internal space between a bottom portion of the water storage tank 13 and the lower cover 11.

A decorative shaped cover 16 is further arranged at an upper portion of the water storage tank 13; and the shaped cover 16 can not only prevent water droplets from splashing outward, but also play a certain decorative role.

A guide cylinder through-hole 161 for penetrating through the guide cylinder 15 is formed in the shaped cover 16;

a backflow hole and/or a vent hole 162 for returning water droplets dripping from the drip hole 172 and in communication with the guide cylinder 15 are/is further formed in the shaped cover 16; and an air inlet hole 151 is formed in the guide cylinder 15.

An assembly limiting rib 153 is arranged on a periphery of the guide cylinder 15; and a buckle matching the assembly limiting rib 153 is arranged on an inner side of the guide cylinder through-hole 161 of the shaped cover 16, and is used for limiting a relative position between the shaped cover 16 and the guide cylinder 15.

An LED light board for producing a lighting effect is arranged inside the humidifier main body or the guide cylinder 15 or inside the water storage cover;

light-transmitting holes 192 and 183 are respectively formed in the upper water storage cover 19 and the water-blocking light-transmitting cover 18; and this disclosure does not specifically limit the shape and number of the light-transmitting holes 192 and 183, and the light-transmitting holes may be arranged in a surrounding manner, and may be circular holes, strip-shaped holes, or in other forms; and the water-blocking light-transmitting cover 18 is of a transparent or translucent structure.

A water level detection switch electrically connected to the control circuit board 112 is further arranged on the inner side of the humidifier main body; and a water level detection position 113 corresponding to a position of the water level detection switch is arranged at the bottom portion of the water storage tank 13.

A water storage cavity for storing water is arranged in the water storage cover; and the water baffle 182 is located at an upper side of the water mist hole 171 in a vertical direction.

A heat dissipation hole 111 can further be formed in the lower cover 11.

A technical effect achieved in this disclosure by resolving the technical problem is as follows:

Compared with the prior art, a dripping spray-type aromatherapy humidifier 1 of this disclosure is provided with a humidifier main body, a guide cylinder 15 connected to the humidifier main body, and a water storage cover located at an upper portion of the guide cylinder 15 simultaneously; a control circuit board 112 and an atomization assembly 12 are arranged in the humidifier main body; the humidifier further includes a drip hole 172 formed in the water storage cover, and a mist spray hole 191 for spraying mist is formed in the water storage cover; the humidifier further includes a water baffle 182 arranged close to an inner side of the mist spray hole 191 and used for preventing mist water from blocking the mist spray hole 191; the guide cylinder 15 is of an internal hollow structure, and the atomization assembly 12 is located at a bottom portion of the guide cylinder 15; mist and mist water generated by the atomization assembly 12 reach the water storage cover after passing through the guide cylinder 15 and drip downward from the drip hole 172; a water storage tank 13 for storing water is formed in the humidifier main body; water dripping from the drip hole 172 flows into the water storage tank 13; and the atomization assembly 12 is electrically connected to the control circuit board 112. In the actual application process, mist generated by the atomization assembly 12 flows into the water storage cover after passing through the guide cylinder 15 and drips downward from the drip hole 172, and mist is sprayed out from the mist spray hole 191. The arrangement of the water baffle 182 can effectively prevent mist water from blocking the mist spray hole 191, making the product operation more stable and extending its service life.

The foregoing implementations of this disclosure do not limit the protection scope of this disclosure. Any modification, equivalent replacement, improvements, etc. made without departing from the spirit and principle of this disclosure shall all fall within the protection scope of the claims of this disclosure.

What is claimed is:

1. A dripping spray-type aromatherapy humidifier, comprising a humidifier main body, a guide cylinder connected to the humidifier main body, and a water storage cover located at an upper portion of the guide cylinder; a control circuit board and an atomization assembly being arranged in the humidifier main body; and further comprising a drip hole formed in the water storage cover, wherein a mist spray hole for spraying mist is formed in the water storage cover; and the humidifier further comprises a water baffle arranged close to an inner side of the mist spray hole and used for preventing mist water from blocking the mist spray hole;

the guide cylinder is of an internal hollow structure, and the atomization assembly is located at a bottom portion of the guide cylinder; and mist and mist water generated by the atomization assembly reach the water storage cover after passing through the guide cylinder and drip downward from the drip hole;

a water storage tank for storing water is formed in the humidifier main body; and water dripping from the drip hole flows into the water storage tank; and the atomization assembly is electrically connected to the control circuit board;

the dripping spray-type aromatherapy humidifier further comprising an atomization energy-gathering cylinder and an atomization piece sinking groove, the atomization energy-gathering cylinder is provided on an inner side of a connection part between the bottom portion of the guide cylinder and the humidifier main body for increasing a height of mist and water sprayed from the atomization assembly, and the atomization piece sinking groove is formed in an inner side of the humidifier main body for embedding the atomization energy-gathering cylinder;

wherein the atomization assembly is mounted at a bottom portion of the atomization piece sinking groove; and a water inlet groove for supplying water to the atomization piece sinking groove is formed in a connection part between the guide cylinder and the humidifier main body or in the bottom portion of the guide cylinder; and water in the water storage tank flows into the atomization piece sinking groove through the water inlet groove.

2. The dripping spray-type aromatherapy humidifier according to claim 1, wherein;

the atomization energy-gathering cylinder is connected to the inner side of the humidifier main body or integrally formed therewith; and the atomization energy-gathering cylinder is located at an upper portion of the atomization assembly.

3. The dripping spray-type aromatherapy humidifier according to claim 1, wherein the water storage cover comprises a lower water storage cover, an upper water storage cover, and a water-blocking light-transmitting cover located between the lower water storage cover and the upper water storage cover;

a top portion of the guide cylinder is connected to the lower water storage cover in a matching manner;

a water mist hole for allowing the mist to flow from the guide cylinder into the water storage cover is formed in the lower water storage cover; and a mist outlet groove for allowing the mist to flow from the water storage cover to the mist spray hole is formed in the water-blocking light-transmitting cover; and the water baffle is arranged close to the mist outlet groove.

4. The dripping spray-type aromatherapy humidifier according to claim 1, wherein the humidifier main body comprises a lower cover;

the water storage tank is located at an upper portion of the lower cover; and the control circuit board and the atomization assembly are located in an internal space between a bottom portion of the water storage tank and the lower cover.

5. The dripping spray-type aromatherapy humidifier according to claim 1, wherein a decorative shaped cover is further arranged at an upper portion of the water storage tank;

a guide cylinder through-hole for penetrating through the guide cylinder is formed in the shaped cover;

a backflow hole and/or a vent hole for returning water droplets dripping from the drip hole and in communication with the guide cylinder are/is further formed in the shaped cover; and an air inlet hole is formed in the guide cylinder.

6. The dripping spray-type aromatherapy humidifier according to claim 5, wherein an assembly limiting rib is arranged on a periphery of the guide cylinder; and a buckle matching the assembly limiting rib is arranged on an inner side of the guide cylinder through-hole of the shaped cover, and is used for limiting a relative position between the shaped cover and the guide cylinder.

7. The dripping spray-type aromatherapy humidifier according to claim 3, wherein an LED light board for producing a lighting effect is arranged inside the humidifier main body or the guide cylinder or inside the water storage cover;

light-transmitting holes are respectively formed in the upper water storage cover and the water-blocking light-transmitting cover; and the water-blocking light-transmitting cover is of a transparent or translucent structure.

8. The dripping spray-type aromatherapy humidifier according to claim 1, wherein a water level detection switch electrically connected to the control circuit board is further arranged on the inner side of the humidifier main body; and a water level detection position corresponding to a position of the water level detection switch is arranged at the bottom portion of the water storage tank.

9. The dripping spray-type aromatherapy humidifier according to claim 3, wherein a water storage cavity for storing water is arranged in the water storage cover; and the water baffle is located at an upper side of the water mist hole in a vertical direction.

10. A dripping spray-type aromatherapy humidifier, comprising a humidifier main body, a guide cylinder connected to the humidifier main body, and a water storage cover located at an upper portion of the guide cylinder; a control circuit board and an atomization assembly being arranged in the humidifier main body; and further comprising a drip hole formed in the water storage cover, wherein a mist spray hole for spraying mist is formed in the water storage cover; and the humidifier further comprises a water baffle arranged close to an inner side of the mist spray hole and used for preventing mist water from blocking the mist spray hole;

the guide cylinder is of an internal hollow structure, and the atomization assembly is located at a bottom portion of the guide cylinder; and mist and mist water generated by the atomization assembly reach the water storage cover after passing through the guide cylinder and drip downward from the drip hole;

a water storage tank for storing water is formed in the humidifier main body; and water dripping from the drip hole flows into the water storage tank; and the atomization assembly is electrically connected to the control circuit board;

wherein the water storage cover comprises a lower water storage cover, an upper water storage cover, and a water-blocking light-transmitting cover located between the lower water storage cover and the upper water storage cover;

a top portion of the guide cylinder is connected to the lower water storage cover in a matching manner;

a water mist hole for allowing the mist to flow from the guide cylinder into the water storage cover is formed in the lower water storage cover; and a mist outlet groove for allowing the mist to flow from the water storage cover to the mist spray hole is formed in the water-blocking light-transmitting cover; and the water baffle is arranged close to the mist outlet groove.

11. The dripping spray-type aromatherapy humidifier according to claim 10, wherein an LED light board for producing a lighting effect is arranged inside the humidifier main body or the guide cylinder or inside the water storage cover;

light-transmitting holes are respectively formed in the upper water storage cover and the water-blocking light-transmitting cover; and the water-blocking light-transmitting cover is of a transparent or translucent structure.

12. The dripping spray-type aromatherapy humidifier according to claim 10, wherein a water storage cavity for storing water is arranged in the water storage cover; and the water baffle is located at an upper side of the water mist hole in a vertical direction.

* * * * *